US005616074A

United States Patent [19]

Chen

[11] Patent Number: 5,616,074

[45] Date of Patent: Apr. 1, 1997

[54] APPARATUS FOR COUNTING COINS

[76] Inventor: Chin-nan Chen, No. 132, Tinghsin Rd., Sanmin Dist., Kaohsiung, Taiwan

[21] Appl. No.: 638,798

[22] Filed: Apr. 29, 1996

[51] Int. Cl.[6] ..... G07D 1/00

[52] U.S. Cl. ..... 453/30; 453/49

[58] Field of Search ..... 453/29, 30, 31, 453/32, 33, 34, 35, 39, 40, 49, 57, 58

[56] References Cited

U.S. PATENT DOCUMENTS

| | | | |
|---|---|---|---|
| 4,036,242 | 7/1977 | Breitenstein et al. | 453/30 |
| 4,148,331 | 4/1979 | Nicolaus | 453/30 |
| 4,589,433 | 5/1986 | Abe | 453/57 |
| 5,092,817 | 3/1992 | Abe | 453/57 |
| 5,098,340 | 3/1992 | Abe | 453/49 X |
| 5,254,032 | 10/1993 | Abe | 453/57 X |

FOREIGN PATENT DOCUMENTS

| | | | |
|---|---|---|---|
| 2185341 | 7/1987 | United Kingdom | 453/57 |

*Primary Examiner*—Karen B. Merritt
*Assistant Examiner*—Scott L. Lowe
*Attorney, Agent, or Firm*—Hedman, Gibson & Costigan, P.C.

[57] ABSTRACT

An apparatus mounted within a game machine for counting coins comprising a housing, a holder obliquely mounted on the housing, a turntable disposed within a channel defined on the holder, a rotor mounted to the center of the turntable, a plate mounted to an extension from the sidewall of the holder, a spout for containing the coins threadedly mounted to a plurality of mounting holes of the holder, and an actuating motor behind the housing to drive the turntable to rotate. In a preferred embodiment, the holder has a shift lever mounted on an upper position and connected with a counter. The turntable includes a drive boss at a center, a ring flange with a smaller diameter defined in concentric circles form with the table on the surface thereof and a plurality of studs nonlinearly arranged in a radial form over the surface between the ring flange and the table's periphery for retaining the coins. The turntable further defines a plurality of blind holes on the undersurface thereof so that rolling elements can be disposed therein in order to assure smooth rotation of the turntable. The rotor has a plurality of bars integrally formed therearound for shifting the coins. The plate has a pair of fingers integrally formed and extending outwardly in order to attach to the ring flange of the turntable and guide the coins. The spout has a movable baffle plate crossing thereover at an upper portion and a planar portion provided over the baffle plate in order to decrease the load on the turn turntable.

4 Claims, 5 Drawing Sheets

APPARATUS FOR COUNTING COINS

BACKGROUND OF THE INVENTION

1. Field of the Invention

The present invention relates to an apparatus for counting coins and, more particularly to an apparatus mounted within a game machine for counting coins.

2. Description of Related Art

A conventional apparatus 3 mounted within a game machine for counting coins generally has the structure as shown in FIG. 6, which is a front view showing the combined structure of the apparatus. The apparatus 3 typically comprises a holder 31 having a plurality of lugs 312 provided therearound for mounting purpose and defining a channel 311. A turntable 32 is disposed within the channel 311. The turntable 32 defines a slot 321 in an undersurface thereof and a plurality of studs 323 spread over an upper surface of the turntable 32. A guide track 322 is disposed within the slot 321 and in communication with the surface of the channel 311. A rotor 33 with several bars 331 is mounted on the turntable 32. The bars 331 are each connected with a spring. An actuating motor (not shown) has a spindle 301 for driving both the turntable 32 and the rotor 33. A blade 34 and a shift lever 35 are mounted on an upper portion of the holder 31, respectively. The shift lever 35 is connected with a counter (not shown). In addition, a plurality of sheets 36 each having a guide portion 361 are mounted to an extension 313 adjacent to the shift lever 35 from the holder 31 and define a space therebetween for the coins to pass through. When activated, the motor drives the turntable 32, the rotor 33, and thus the coins on the table 32 to rotate by means of its spindle 301. When the coins move and touch the shift lever. 35, the counter begins to count and the coins drop into a spout (not shown) threadedly mounted to the lugs 312 on the holder 31, along the space defined by the sheets 36.

Though this kind of apparatus may achieve the aim of counting coins, it still has several disadvantages that too many parts, such as the guide track 322 and springs are required and coins may become jammed between the rotor 33 and the turntable 32 in operation due to the manner of the bars 331 mounting with their springs.

The present invention provides an improved apparatus 14 for counting coins to mitigate and/or obviate the aforementioned problems.

SUMMARY OF THE INVENTION

One object of the present invention is to provide an apparatus for counting coins which has a plurality of communicating holes for containing rolling elements on the bottom of a turn plate in order to obtain a smooth rotation of the turntable.

Another object of the present invention is to provide an apparatus for counting coins which has a plurality of studs nonlinearly arranged over the surface of the turntable in order to adapt to various coins.

A further object of the present invention is to provide an apparatus for counting coins which has a rotor with a plurality of bars integrally formed therearound in order to prevent the coins from becoming jammed.

Still a further object of the present invention is to provide an apparatus for counting coins which has a movable. baffle plate disposed in the coin spout in order to decrease the pressure on the turntable resulted from too many coins being disposed thereon.

In accordance with one aspect of the present invention, the apparatus for counting coins comprises a housing; a holder obliquely mounted on the housing, said holder defining a plurality of mounting holes and having a shift lever disposed at an upper position and connected with a counter (not shown), said holder further comprising an extension extending from a sidewall near the shift lever of the holder; a turntable disposed within a channel defined in the holder, said turntable including a drive boss at a center thereof, a ring flange with a smaller diameter defined in concentrically with the turntable on the surface thereof and a plurality of studs nonlinearly arranged in a radial direction over the surface between the ring flange and the turntable's periphery for retaining the coins, said turntable further defining a plurality of blind holes in an undersurface thereof so that rolling elements can be disposed in the blind holes in order to assure smooth rotation of the turntable; a rotor mounted to the center of the turntable, said rotor having a plurality of bars therearound for shifting the coins; a plate mounted to the extension of the holder, said plate having a pair of fingers integrally formed and extending outwardly in order to attach to the ring flange of the turntable; a spout for containing the coins mounted to the holder through the mounting holes thereon, said spout having a movable baffle plate crossing thereover at an upper portion and a planar portion disposed over the baffle plate; and an actuating motor mounted behind the housing to drive the turntable to rotate, said motor having a spindle extending through the center of the holder and the drive boss of the turntable in turn to mount with and drive the rotor and the turntable.

In accordance with another aspect of the present invention, the rolling elements are composed of rollers.

Other objects, advantages and novel features of the invention will become more apparent from the following detailed description when taken in conjunction with the accompanying drawings.

DETAILED DESCRIPTION OF PREFERRED EMBODIMENT

Figure 1:
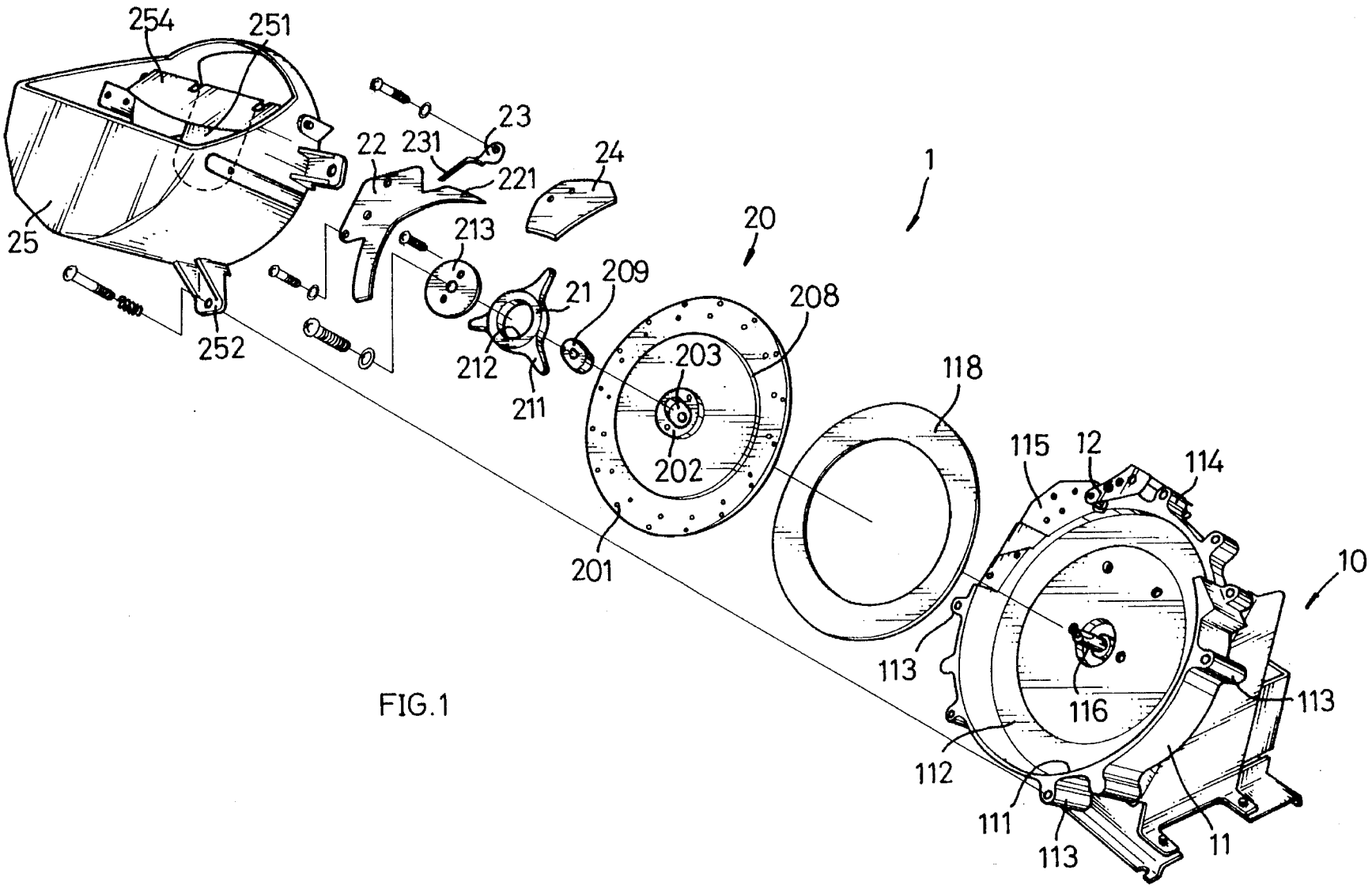
FIG. 1 is an exploded perspective view showing an apparatus for counting coins in accordance with the present invention.
Figure 5:
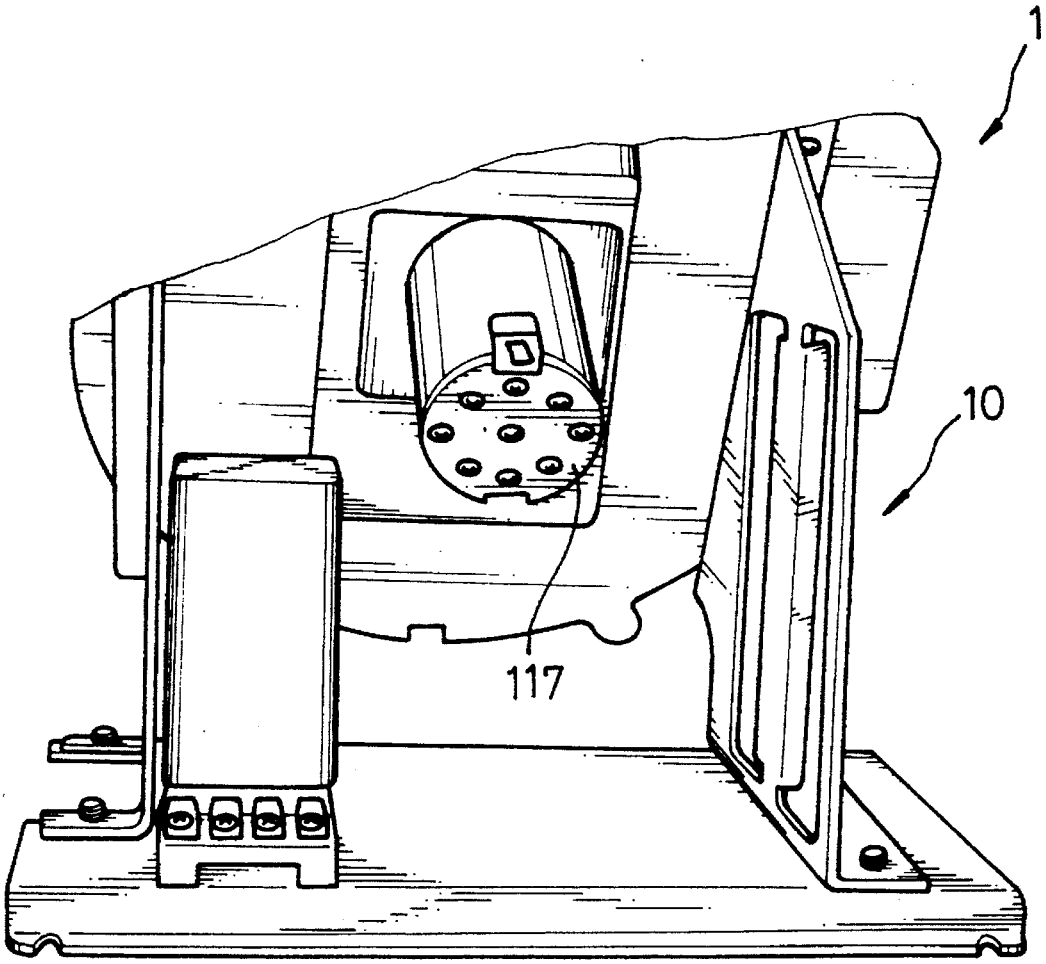
FIG. 5 is a back view showing the apparatus in accordance with the present invention.
Figure 6:
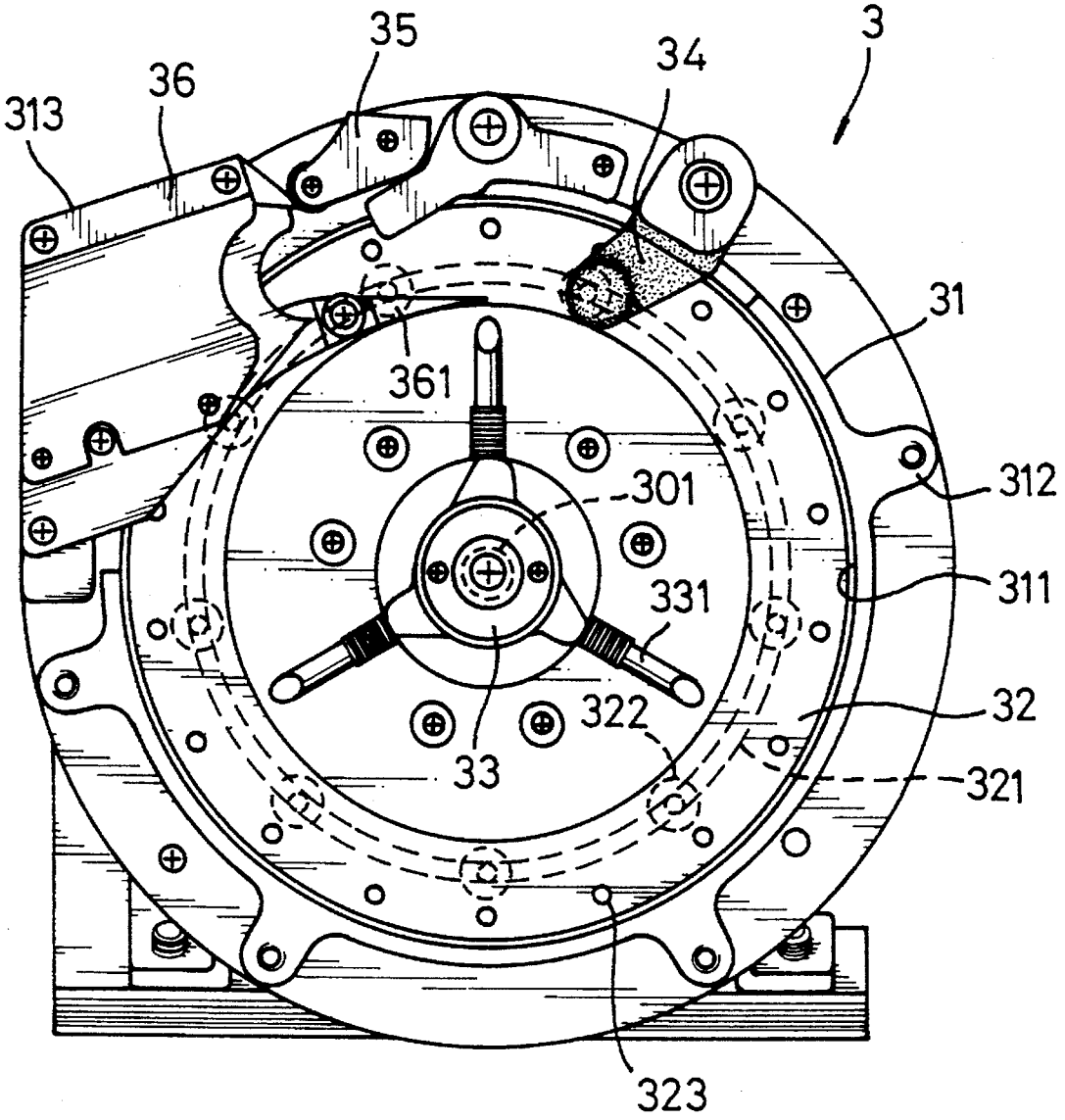
FIG.6 PRIOR ART
FIG. 6 is a side view showing a conventional apparatus for counting coins.

Referring to FIG. 1, an apparatus 1 for counting coins in accordance with the present invention is composed of a housing 10, a holder 11, a turntable 20, a rotor 21, a plate 22, a spout 25 and an actuating motor 117 (see FIG. 5).

The holder 11 is obliquely mounted on the housing 10. A plurality of lugs 113 each defining a mounting hole are provided on a periphery of the holder 11. A further lug 114 having a hole defined therein is provided in an upper position on the holder 11 and a shift lever 12 connected with a counter (not shown) is mounted on the holder 11 and near the further lug 114. A perforated extension 115 is extended from a sidewall near the lever 12 of the holder 1t.

Figure 3:
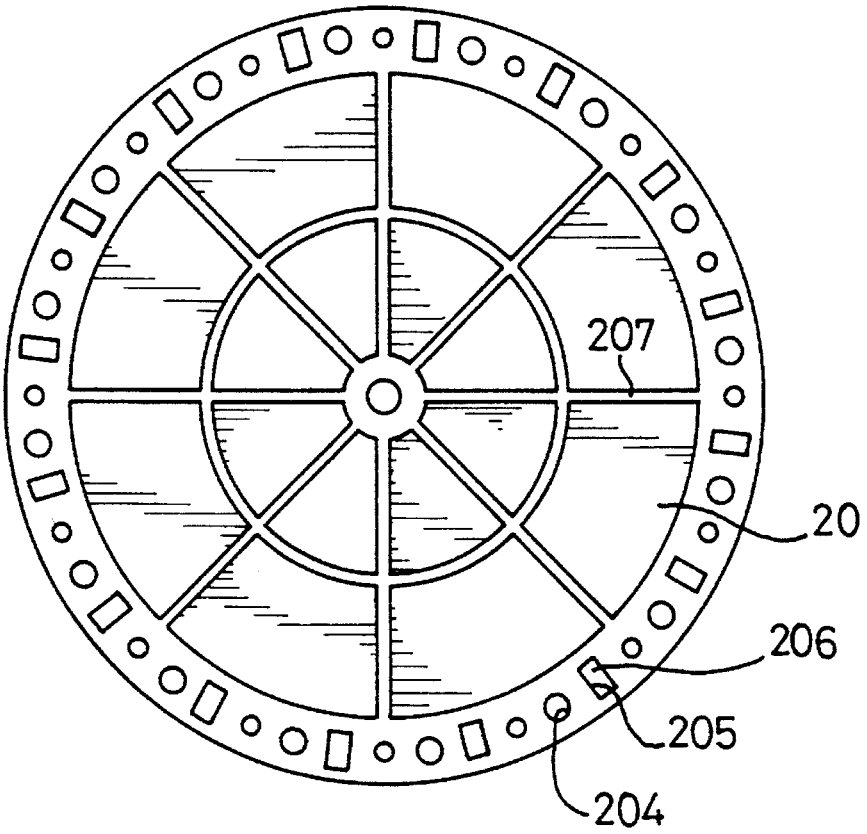
FIG. 3 is a bottom view showing a turntable of the apparatus in accordance with the present invention.

The turntable 20 is disposed within a channel 111 defined on the holder 11, and includes a drive boss 202 disposed at a center thereof, a locating slot 203 defined within the drive boss 202, a ring flange 208 with a smaller diameter defined in concentric circles form with the table 20 on the surface thereof and a plurality of studs 201 nonlinearly arranged in a radial form over the surface between the ring flange 208 and a periphery of the turntable 20 for retaining the coins when rotated. Also referring to FIG. 3, the turntable 20 further defines a plurality of blind holes 204 and through holes 205 on an undersurface thereof so that rolling elements such as rollers 206 and balls are respectively disposed in the through holes 205, or disposed in the blind holes 204, in order to assure smooth rotation of the turntable 20. Furthermore, for reinforcement, a plurality of ribs 207 are strutted at the bottom of the turn plate 20.

The rotor 21 is mounted to the drive boss 202 of the turntable 20. The rotor 21 defines an aperture 212 corresponding to the drive boss 202 for mounting thereon and has a plurality of arms 211 integrally formed therearound for rotatingly shifting the coins. In addition, a locating washer 213 is mounted on the rotor 21 by screws extending therethrough.

The plate 22 is mounted to the extension 115 of the holder 11. The plate 22 has a pair of fingers 221 integrally formed and extending outwardly in order to attach to the ring flange 208 of the turntable 20.

The spout 25 for containing the coins is mounted to the lugs 113 on the holder 11. The spout 25 has a movable baffle plate 251 crossing thereover at an upper portion and a planar portion 254 provided over the baffle plate 251. The planar portion 254 is further connected with a microswitch (not shown).

The apparatus for counting coins further comprises a retainer 23 with a strip portion 231 mounted to the further lug 114 on the holder 11 for retaining the coins when the turntable 20 is rotated, and a locating sheet 24.

Figure 2:
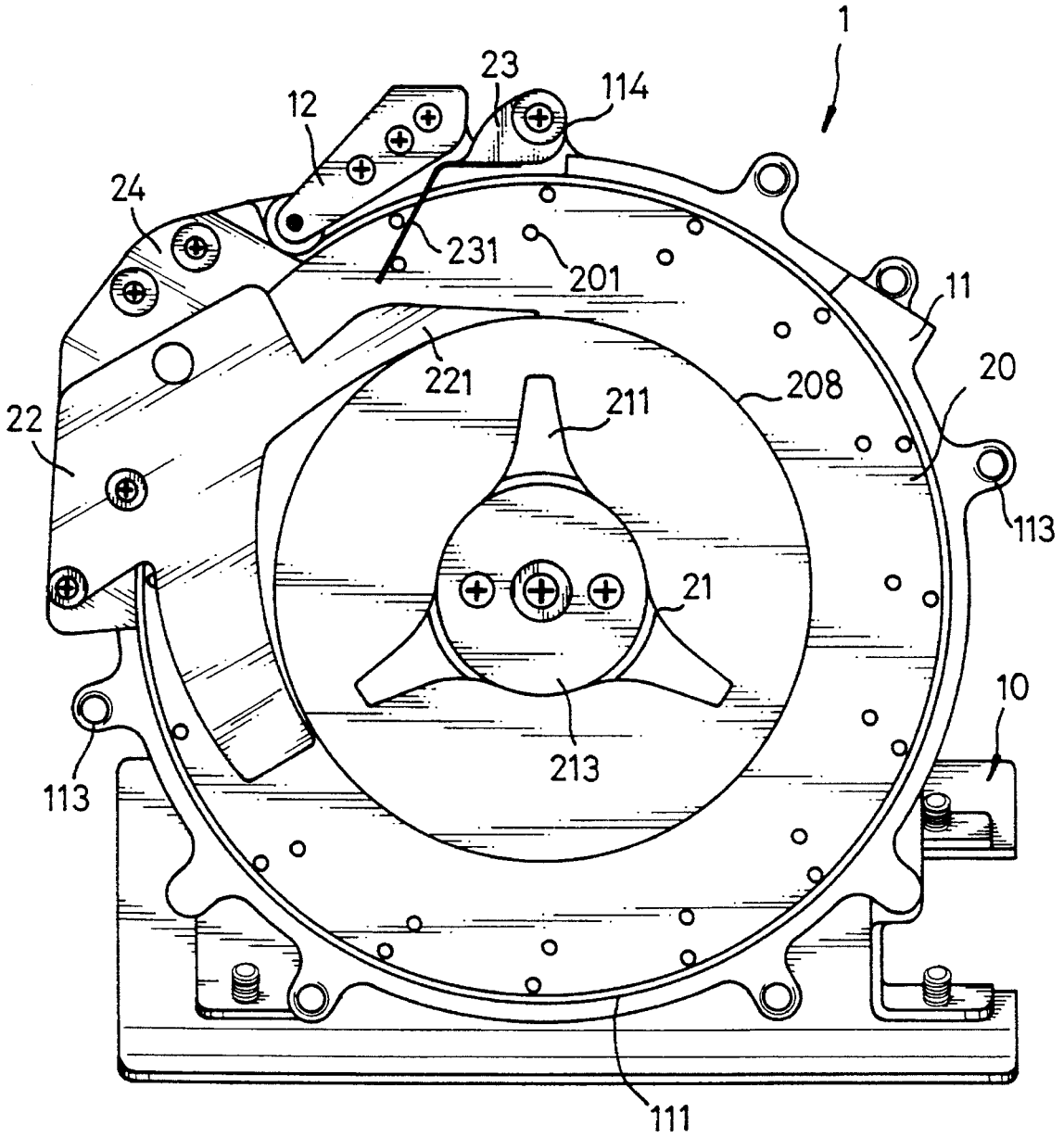
FIG. 2 is a front view showing the combined structure of the apparatus in accordance with the present invention.
Figure 4:
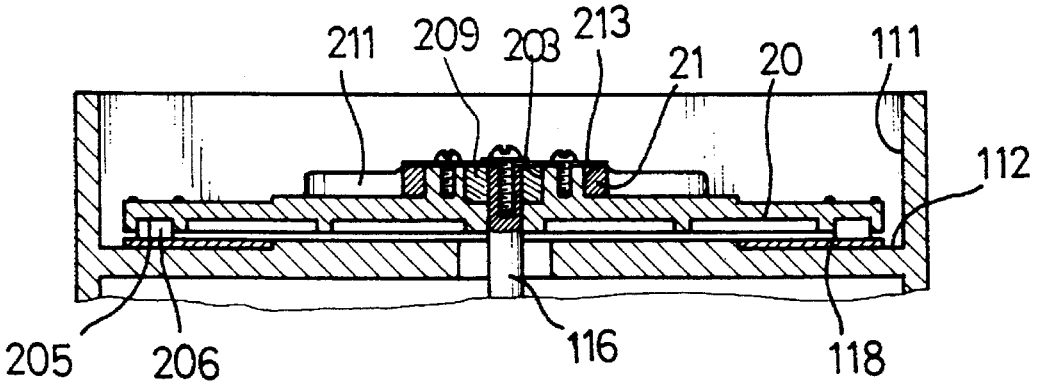
FIG. 4 is a cross-sectional view showing a combined structure of the turntable, a rotor and a holder of the apparatus in accordance with the present invention.

With a reference to FIGS. 2, 4 and 5, it can be seen that the electric motor 117 is mounted behind the housing 10 to drive the turntable 20 to rotate. The motor 117 has a spindle 116 extending through a center of an upper surface 112 of the holder 11 and the locating slot 203 of the turntable 20. In assembly, firstly, a spacer 118 is set on the upper surface 112 of the holder 11, then the turntable 20 is set in the channel 111 of the holder 11 so as to enable the rollers 206 in the through holes 205 thereof to contact with the spacer 118 so that the turntable 20 can obtain a smooth rotation. The spindle 116 extends beyond a center of the upper surface 112 of the holder 11 and the locating slot 203 of the turntable 20 and has mounted therein a drive block 209 which is drivingly engaged with the drive boss 202. Next, the rotor 21 is set with its aperture 212 on the drive boss 202 of the table 20 and is covered and engaged by the locating washer 213. Whereby, as the spindle 116 extends through the abovementioned elements, it is capable of driving the rotor 21 and turntable 20.

Next, the retainer 23 is mounted to the further lug 114 on the holder 11 and the plate 22 and locating sheet 24 are mounted to the extension 115 on the holder 11, respectively. Wherein, the sheet 24 is located beneath the plate 22 and the space defined therebetween allows only one coin to pass therethrough. The spout 25 has a plurality of extending spacers 252 integrally formed thereon and a plurality of screws extending through the spacers 252, to be received in the lugs 113.

In operation, referring to FIG. 2, when activated, the motor 117 drives the rotor 21 and the turntable 20 to rotate so that the coins are shifted by the arms 211 on the rotor 21 and retained by the studs 201 on the turntable 20 in order to be arranged one by one on the upper surface of the turntable 20 and rotate with the turntable 20. It is noted that due to nonlinear arrangement of the studs 201, various sizes of coins can be accepted. When a coin arrives at and touches the shift lever 12 along the pair of fingers 221, the counter connected with the lever 12 begins to count. Then the coin is sent out along the space defined by the sheet 24 and the plate 22. If two coins overlap, the strip portion 231 of the retainer 23 will limit one of the two coins and shift the other coin so as to prevent the coins from becoming jammed. If there are too many coins to be processed the coins will press the planar portion 254 which then triggers the microswitch to stop the run of the coins so as to reduce the pressure on the turntable 20, thereby decreasing the load on the actuating motor.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An apparatus for counting coins comprising:

a housing;

a holder obliquely mounted on the housing, said holder defining a plurality of mounting holes and having a shift lever mounted on an upper position and connected with a counter, said holder further comprising an extension extending from a sidewall near the lever of the holder;

a turntable disposed within a channel defined on the holder, the turntable defining a ring flange with a smaller diameter defined in concentrically with the table on a surface thereof and a plurality of studs nonlinearly arranged in a radial form over a surface between the ring flange and a periphery of the turntable for retaining coins, said turntable further defining a plurality of blind holes on an undersurface thereof so that rolling elements can be disposed in the blind holes in order to assure smooth rotation of the turntable;

a rotor mounted to a center of the turntable, said rotor having a plurality of arms therearound for shifting the coins;

a plate mounted to the extension of the holder, said plate having a pair of fingers integrally formed and extending outwardly in order to attach to the ring flange of the turntable;

a spout for containing the coins mounted to the holder through the mounting holes thereon, said spout having a movable baffle plate crossing thereover at an upper portion and a planar portion provided over the baffle plate; and an actuating motor mounted behind the housing to drivingly rotate the turntable.

2. The apparatus as claimed in claim 1, wherein the rolling elements are composed of rollers.

3. The apparatus as claimed in claim 1, wherein the turntable comprises a drive boss at a center, the drive boss defining a locating slot therein for receiving a drive block.

4. The apparatus as claimed in claim 3, wherein the actuating motor comprises a spindle extending through the center of the holder and the locating slot of the drive boss.

* * * * *